US007794107B2

(12) United States Patent
Schoen et al.

(10) Patent No.: US 7,794,107 B2
(45) Date of Patent: Sep. 14, 2010

(54) DEVICE FOR THE OPTICAL DISPLAY OF N SWITCHING STATES

(75) Inventors: Dierk Schoen, Egelsbach (DE); Dionissios Divaris, Griesheim (DE)

(73) Assignee: Pepperl + Fuchs GmbH, Mannheim (DE)

( * ) Notice: Subject to any disclaimer, the term of this patent is extended or adjusted under 35 U.S.C. 154(b) by 756 days.

(21) Appl. No.: 10/572,199

(22) PCT Filed: Sep. 17, 2004

(86) PCT No.: PCT/EP2004/010486

§ 371 (c)(1),
(2), (4) Date: Dec. 6, 2006

(87) PCT Pub. No.: WO2005/029522

PCT Pub. Date: Mar. 31, 2005

(65) Prior Publication Data

US 2007/0085761 A1 Apr. 19, 2007

(30) Foreign Application Priority Data

Sep. 19, 2003 (DE) ..... 103 43 529

(51) Int. Cl.

| | |
|---|---|
| ***F21V 9/00*** | (2006.01) |
| ***F21V 23/04*** | (2006.01) |
| ***F21S 4/00*** | (2006.01) |
| ***H01H 9/00*** | (2006.01) |
| ***G08B 5/00*** | (2006.01) |

(52) U.S. Cl. ..... 362/231; 362/249.12; 362/276; 200/317; 340/815.65; 340/815.73

(58) Field of Classification Search ..... 362/231, 362/85, 227, 230, 249.02, 249.14, 249.12, 362/276; 307/112; 340/635, 637, 815.45, 340/815.47, 815.49, 815.55, 815.56, 815.65, 340/815.73; 200/317
See application file for complete search history.

(56) References Cited

U.S. PATENT DOCUMENTS 3,555,543 A * 1/1971 Lynch ..... 340/815.76

(Continued)

FOREIGN PATENT DOCUMENTS

DE 19914281 C1 3/2000

(Continued)

*Primary Examiner*—Jong-Suk (James) Lee
*Assistant Examiner*—David R Crowe
(74) *Attorney, Agent, or Firm*—John W. LaBatt; Hoffman Warnick LLC

(57) ABSTRACT

The invention relates to a device for the optical display of n switching states of a switching device or sensor, with a plurality of differently coloured lighting devices for the optical display of the information to be transmitted and each lighting device has at least one lighting element. The device is characterized in that, for receiving the lighting elements, a transparent casing part is provided that for avoiding optical cross-talk, particularly in the case of simultaneously active lighting elements, the transparent casing part is subdivided into segments by optical interfaces and in which the lighting elements are received, and that the transparent casing part with the segments and lighting devices is so constructed and positioned that the lighting devices are visible to a user from any azimuth angle within a polar angle range.

29 Claims, 6 Drawing Sheets

U.S. PATENT DOCUMENTS

| | | | | | |
|---|---|---|---|---|---|
| 3,639,745 | A | * | 2/1972 | Shiki | 200/311 |
| 3,743,828 | A | * | 7/1973 | Fiorenzo et al. | 40/444 |
| 4,984,142 | A | * | 1/1991 | Garnerone | 362/249.1 |
| 5,103,215 | A | * | 4/1992 | Taylor et al. | 340/691.8 |
| 5,302,965 | A | | 4/1994 | Belcher et al. | |
| 5,490,049 | A | | 2/1996 | Montalan et al. | |
| 5,580,156 | A | | 12/1996 | Suzuki et al. | |
| 5,929,788 | A | | 7/1999 | Vukosic | |
| 6,011,467 | A | * | 1/2000 | Kamei et al. | 340/540 |
| 6,631,575 | B1 | | 10/2003 | Voelzke et al. | |
| 6,674,416 | B2 | * | 1/2004 | Kamei et al. | 345/39 |
| 6,679,621 | B2 | * | 1/2004 | West et al. | 362/327 |
| 6,882,111 | B2 | * | 4/2005 | Kan et al. | 315/122 |
| 7,009,525 | B1 | * | 3/2006 | Shafiyan-Rad et al. | 340/815.43 |
| 7,097,322 | B2 | * | 8/2006 | Shuniak | 362/199 |
| 7,442,125 | B2 | * | 10/2008 | Paulsen et al. | 463/30 |
| 2002/0114155 | A1 | * | 8/2002 | Katogi et al. | 362/219 |

FOREIGN PATENT DOCUMENTS

| | | | | |
|---|---|---|---|---|
| DE | 10019888 | A1 | | 10/2001 |
| EP | 1058226 | A2 | | 5/2000 |
| WO | WO 02/00469 | A1 | | 1/2002 |
| WO | WO 03058659 | A1 | * | 7/2003 |

* cited by examiner

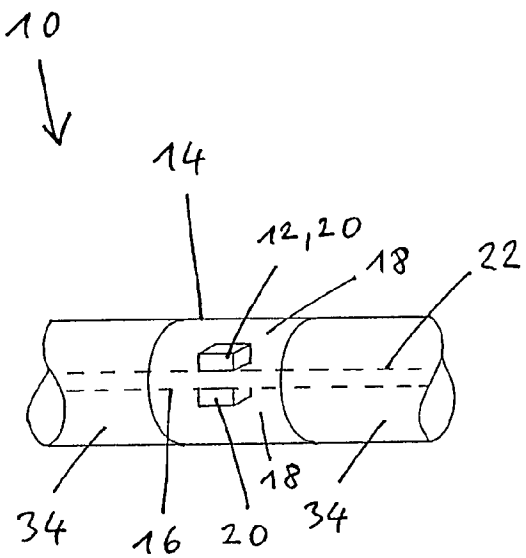
Fig. 14
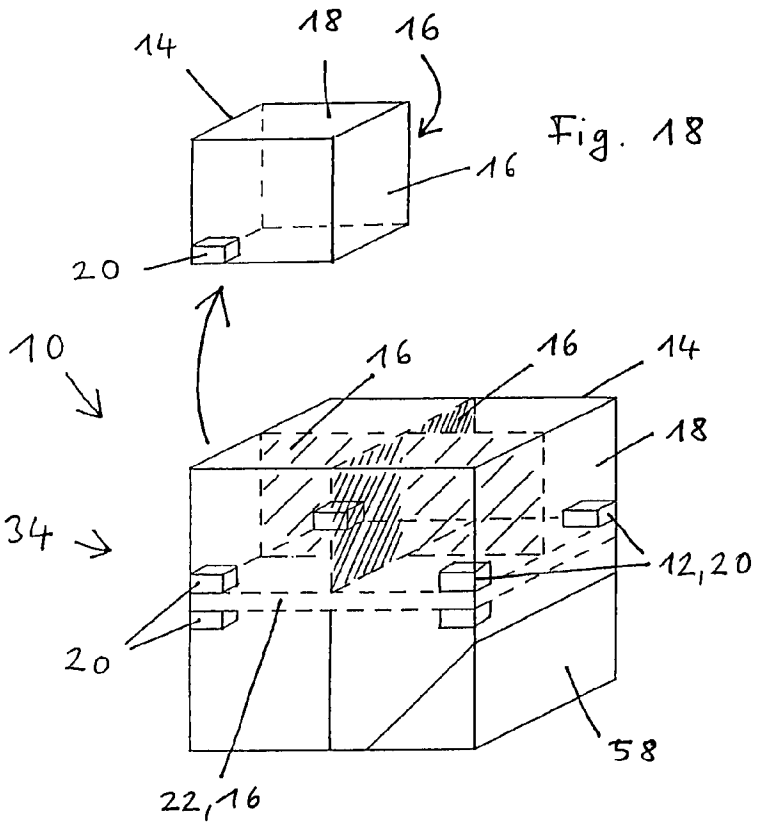
Fig. 18
Fig. 13

DEVICE FOR THE OPTICAL DISPLAY OF N SWITCHING STATES

This application claims priority to PCT Application No. PCT/EP2004/010486 filed Sep. 17, 2004, which claims the benefit of German Application No. 103 43 529.8 filed Sep. 19, 2003, both of which are hereby incorporated herein by reference.

The invention relates to a device for the optical display of n switching states of a switching device or sensor according to the preamble of claim 1.

Such a device, with a plurality of different coloured lighting or illuminating devices for the optical display of the information to be transmitted, where each illuminating or lighting device has at least one illuminating or lighting element is described in DE 202 17 773 U1 and the related co-owned and co-pending U.S. patent application Ser. No. 10/535,019, which was filed on May 12, 2005 and is hereby incorporated herein by reference. To permit the visibility of the display devices from virtually all spatial directions, the device makes use of a casing for receiving an electrical switching device or sensor, in which each lighting device has a plurality of lighting elements, which are so arranged facing one another on the casing that at least one lighting element of each display device is visible from virtually any viewing direction.

In the case of electronic circuits housed in plastic or metal sleeves or casings or which are encapsulated in some other way, use is frequently made of a lighting means in the form of a bulb or light emitting diode, particularly a SMD-LED, for the display of switching states. The aim is to provide very good visibility of the displays, preferably in all three space axes. Often, a problem arises in which such displays appear with very poor illumination.

Casings for receiving electrical switching devices or sensors, which have display devices for displaying different electrical switching states for monitoring the functionally correct operation of the electric circuit, electric switching device or sensor are known from, for example, DE 202 17 773 U1.

DE 195 12 915 C1 discloses an electrical connecting element, such as, for example, a plug or coupling, where, for improving the visibility of a luminaire, a device for deflecting the light emitted by the luminaire is provided.

DE 196 27 211 A1 discloses an ultrasonic proximity switch in the form of a multistory car park sensor, in which the top and bottom parts of a casing can be rotated against one another so that, if desired, an optical display can be oriented.

DE 296 20 001 U1 describes a warning light device equipped with light emitting diodes, in which an emission area is subdivided with the aid of partitions into different segments.

DE 200 08 944 U1 relates to a lighting unit, in which several light emitting diodes are introduced into a transparent casing part.

An object of the invention is to provide a device of the aforementioned type with improved visibility of the optical display, also in daylight, together with reliable recognition or identification of the displayed information.

According to the invention this object is achieved by a device for the optical display of n switching states of a switching device or sensor with a plurality of different coloured lighting devices for the optical display of the information to be transmitted, each lighting device having at least one lighting element, characterized in that a transparent casing part is provided for receiving the lighting elements, that for avoiding optical crosstalk, particularly in the case of simultaneously active lighting elements, the transparent casing part is subdivided by optical interfaces into segments in which the lighting elements are received and that the transparent casing part with the segments and lighting devices is so constructed and positioned that the lighting devices are visible by a user from each azimuth angle within a polar angle range.

Advantageous variants and further developments form the subject matter of the dependent claims.

The device of the aforementioned type is, according to the invention, further developed in that a transparent casing part is provided for receiving the lighting elements, that the transparent casing part is subdivided by optical interfaces into segments to avoid optical crosstalk, particularly in the case of simultaneously active light elements and which serves to receive said lighting elements, and that the transparent casing part is so constructed and positioned with the segments and lighting devices that the latter are visible for a user from each azimuth angle within a polar angle range.

The concept of an electrical switching device is to be understood in very general terms here. In principle, the inventive device displays switching states, e.g., of a transistor stage, of random electrical and/or electronic equipment.

The first essential idea of the invention is to construct, in a transparent manner, part of a casing for receiving an electrical switching device or sensor, and said transparent casing part for receiving a plurality of display or lighting devices for displaying different electrical switching states of the electrical switching device or sensor is to be subdivided into segments with the aid of optical interfaces. As a result, and in particular with simultaneously active display or lighting devices, optical crosstalk is avoided.

A further essential idea of the invention is that the transparent casing part, which also be in the form of a transparent adaptor or transparent end termination, is so constructed and arranged with the segments and lighting devices that the display or lighting devices are visible from virtually any spatial direction for the user and in particular within a use area. This makes it possible to achieve very good visibility of the lighting devices, and therefore, a much improved recognition of the displayed optical information, i.e., particularly the switching states of the relevant device. As a result of the segmentation, on viewing the plurality of, for example, planar or spatial segments of the transparent casing part from a random spatial direction, the display or lighting devices are simultaneously visible from any spatial direction. In particular, due to the transparent end termination projecting from a sensor end, the dead zone of the visible solid angle can be kept smaller than 20°. In a further advantageous development, due to the transparent design of an entire part of the casing, the dead zone of the solid angle in which individual segments of the display cannot be seen, can be kept very small, particularly smaller than 20°.

Furthermore, the inventive arrangement and subdivision of the display devices or lighting devices, for example, a sensor into segments, makes it possible for more than one lighting means to light up at the same time without the illuminating or light spots running into one another. Thus, there is a very good all-round visibility of one or more displays, which also light up at the same time. Thus, apart from the switching state display, the device according to the invention is also suitable for communication with an operator.

For the display of the n switching states, the lighting devices can in particular be activated independently of one another. If the lighting devices also have different colours, it is possible, for example, with two lighting devices and independently of the geometrical positioning thereof to display and transmit 2 bits of information.

The segment-illuminating light energy is fed via the orientation of the lighting means and through the use of light-conducting material into the particular segment of the n-segment display with which can be, in each case, associated one or more lighting means. In a specific caseuse can be made of transparent casting resin, because this leads to the best coupling.

The display devices are in particular constructed as punctiform lighting devices, which can, for example, in each case, have at least one lighting element, particularly at least one bulb or LED. However, in principle any device for displaying optical information can be used as the lighting or display device, e.g., an adequately illuminated liquid crystal display also can be used.

To obtain a particularly good all-round visibility, it is also appropriate to position the lighting elements belonging to a lighting device on facing sides of the transparent casing part. For most applications, two lighting elements per lighting device are adequate. However, a particularly good all-round visibility can be achieved if use is made of more than two, e.g., three or four, lighting elements, which are distributed over the circumference of the transparent casing part.

The device according to the invention with a transparent body or casing part is used for displaying n switching states in the n segments of the display of electrical switching devices or sensors or for transmitting information from said switching devices or sensors for communicating with the operator. For example, it is possible to read out sensor information and the operator can carry out low level programming with the aid of the lighting display information. The transparent body is implemented as an n-segment display on cylindrical, polygonal or round sensor casings.

The device according to the invention is suitable for all standard sensor types in automation technology.

The device according to the invention also permits a very good quasi-all-round visibility of the individual differently or identically coloured lighting means at the same time, particularly laterally and behind the sensor and, although to some extent concealed by the unavoidable dead zone of the sensor, from the front, i.e., at the sensor end where the particular sensor element is located.

To increase functional reliability or obtain an even better visibility of the lighting devices, appropriately in the case of one or several lighting devices, a plurality of lighting elements can be provided, which are located, for example, in the facing or a random other segment of the transparent body or end termination in the form of a spatial circle, sphere or polygon (cf. FIGS. 7 and 8). To improve visibility and recognition, said lighting elements, more particularly whilst taking account of their respective emission characteristics and the sequence of the arrangement, can be placed in a row and in parallel at the respective extremities of the printed circuit board on a support side of the electrical circuit in the segments of the transparent casing part.

A further improvement to recognition and visibility can be achieved in that the segments of the transparent casing part are constructed in a planar and/or planar-spatially extended manner. Unlike in the prior art, such planar and/or planar-spatially extended emitters can be less easily concealed or covered by objects having a limited extension.

In the case of the inventive device, the display devices for displaying different electrical switching states or positions of the switching device or sensor can be clearly identified from any spatial direction. Individual or several lighting means can light up simultaneously and/or in planar and/or planar-spatial manner without influencing one another.

The device according to the invention can be implemented in a very cost-effective way and can be particularly easily installed.

Preferably, the fitting of the display element, i.e., the transparent casing part, takes place on the ends of cylindrical, polygonal or round sensors. A central fitting is also possible in the case of elongated sensors. However, then in the case of a cylindrical sensor, for example, there is a second dead zone lobe in the sensor longitudinal direction, which can have an opening angle of approximately 20°, e.g., as a function of the effective diameter of the extended casing.

In principle, a very considerable design freedom exists when specifically constructing the transparent casing part. Thus, the transparent casing part for the casing of the switching device or sensor can be given, for example, a substantially cylindrical, round, polygonal, particularly rectangular or parallelepipedic construction. The switching device or sensor can be in particular an inductive, optical, capacitive, ultrasonic, microwave, temperature, fill level, infrared, ultraviolet, pressure and/or flow sensor. Appropriately, there are in particular at least two differently coloured switching displays.

Through an appropriate use of the inventive concept, it is possible to achieve a quasi-all-round visibility of the displays. With this display type, it also possible to very simply and cost effectively implement more complex uses, where the user wishes to communicate with the sensor via light emitting diodes. The display technology is eminently suitable for sensors with plugs and with a direct cable run, but also for wireless sensors. Basically, the use potential of the invention is very significant, because the concept is completely independent of the switching device or sensor to be monitored.

In particular, the transparent casing part can be constructed for terminal and/or central fitting to a casing. Preferably, the transparent casing part is constructed in such a way that the lighting devices are visible to the user from any azimuth direction, independently of the number of segments, at least in one half-space and/or in a specific polar angle range, particularly a polar angle range between 20 and 160° for central arrangement or 20 to 180° for terminal arrangement. The term polar angle is understood to be the angle against a cylinder axis. Correspondingly, the azimuth angle is the angle measured in a rotary direction around the cylinder axis.

In a particularly preferred further development of the invention, the optical interfaces are formed by printed circuit boards carrying the lighting elements. This brings about a very compact structure and saves material and production costs. The lighting elements are appropriately constituted by light emitting diodes, particularly SMD light emitting diodes.

In another advantageous development in this connection, a printed circuit board equipped with lighting elements can be slid into the transparent casing part. In this case, the device according to the invention can be manufactured in a particularly simple way. For fixing or guiding the printed circuit board relative to the transparent casing part or transparent end termination, it is possible to provide, for example, locking connections.

Thus, for installation purposes, a rigid or flexible printed circuit board, which can be equipped with lighting means, i.e., SMD-LEDs or conventional light bulbs, is slid into the transparent body at the ends of the sensor. However, it also is possible to place a transparent body centrally on the longest side of the sensor and then the optical separation of the segments is brought about by a printed circuit board or other suitable visible interfaces, e.g., boundary surfaces of casting resins, inserted parts, such as, for example, cables or independent separating planes.

The transparent body or transparent casing part couples the light in a defined manner in n segments, e.g., advantageously n=1 to 4, out of the planar and/or planar-spatially designed light coupling out surface. In particular, the printed circuit board, a printed circuit board element, cable or other in a defined manner introduced separations can function as optical interfaces within the transparent body.

An increase in light scattering, and therefore an improvement to the visibility of the lighting devices, is brought about if an outer face of the transparent casing part is at least partly or zonally roughened.

In this connection, further improvements can be brought about in that for increasing light scattering, light scattering elements are incorporated in a planar distributed manner and at least zonally into the transparent casing part material.

Thus, the all-round visibility can be improved by introducing gloss or dye pigments and a corresponding design of the surface in conjunction with the transparent casing part or transparent body. For a better scattering and refraction of the light, in spite of the sealing compound, in addition to the roughened surfaces and mixing of different plastics, pigments, e.g., pearling gloss pigments, can be introduced into the plastic. For example, use can be made of Irodin Pearlescent. In addition, the transparent luminaire, i.e., the transparent body or end termination, the cylindrical, round or polygonal transparent body in the case of elongated sensors, and the plug insert are given a better design, i.e., the sensor is optically upgraded.

In order to use all the light emitted by a lighting element and conduct said light to the outside, the interior of the transparent casing part can at least partly be silvered. The coupling in of light then takes place via the transparent casing wall between the outer face and the mirror coating.

The emission characteristics of the lighting devices also can be influenced by cavities introduced in a clearly defined manner into the transparent casing part. In particular, this can limit the light emission angle for one segment.

The device according to the invention is particularly suitable for equipment and sensors with connectors and outgoing cables having a direct cable connection or with plug devices such as are conventionally used with sensors.

As a result of the encapsulation and the diffusion of the emitted light quantity limiting the light energy, the inventive device is also eminently suitable for uses in explosion-protected sectors.

In preferred developments of the invention, the transparent casing part is constructed as part of a sensor casing or, in particular, as a fully transparent, tubular plug insert, which also can be plugged onto the correspondingly shaped casing sleeve and/or can be passed through said casing sleeve. This construction, in the same way as a transparent casing part constructed as a compact end termination, allows full all-round visibility, i.e., n=1, provided that it is only necessary to display two switching states at different times.

A particularly compact construction is obtained if the transparent casing part has one or more cable bushings, in particular, which can be designed as part of an optical interface. The number and design of the cables decisively determines the number and subdivision of the segments.

The device according to the invention is also eminently suitable for use in forked casings, in which the transparent casing part or transparent end termination is provided, for example, on the fork ends of the particular fork leg and/or, as desired, on both fork legs. However, variants also are possible in which, to improve the visibility of the light in the case of forked barriers, the sensor is enclosed in a completely transparent casing. In this case, the sensor casing is substantially identical with the transparent casing part. In this construction, the interfaces of the casing, printed circuit boards and connecting elements in the casing permit a segmentation of the display, preferably into four quadrants, but also into one or two or more segments (n segments).

The optical interfaces, which also can be called visible interfaces, can be made from, for example, casting resins or other suitable and spatially-planar shaped plastics. For example, cables can serve as part of the interfaces.

An increased number of possibilities for information transmission can be brought about if a plurality of, in particular, differently coloured lighting devices is provided in each segment. These can be arranged in parallel or in row form in one of the sensor axes, particularly in the case of polygonal sensors also on a printed circuit board, so that for certain display modes several segments can light up simultaneously in different colours that can be chosen by the user.

In another advantageous variant, the transparent casing part is given a transparent construction not only for visible light, but also for infrared and/or ultraviolet light. In this connection, it is particularly appropriate for one or more segments to be in the form of an optical interface for an external computer means, particularly an IR or UV interface for a PC. Thus, in this variant, as a result of the transparent body, not only is visible light subdivided into a plurality of segments, but simultaneously there is a favourable connection structure with a PC interface. The interruption of the sensor, and therefore the shielding on the elongated side of the switching device, also permits a radio-assisted communication with other peripherals, apart from state displays.

For certain applications, it is appropriate and desired for segments adjacent to a light-emitting segment to also light up, provided that the lighting means located therein are not themselves active. However, colour mixing must be prevented if the lighting devices of adjacent segments are simultaneously active. This functionality, i.e., the avoidance of a mixing of colours and also an overcoupling of light or a clearly defined transmission of light from one segment into another segment, can be brought about if the transparent luminaire, such as, for example, casing centre, plug part or end termination, has at least one specially shaped, optical bridge from one segment into the adjacent segment. In such a device, the optical interfaces are interconnected via the wall of the transparent luminaire, with or without casting. The transparent luminaire ensures a transmission of part of the light of one segment into the other, particularly adjacent segments, provided that they are not simultaneously active, so that they also light up, particularly if the individual segments are once again filled with a sealing compound. However, the optical interfaces prevent a mixing of colours if the lighting devices in two adjacent segments are simultaneously active.

Advantageous use possibilities of the n-segment display according to the invention also occur in the motor vehicle sector and in consumer technology.

In the car sector, in general terms the principle of the n-segment display can be used with particular advantage for longitudinally cylindrically shaped function levers, particularly at the end thereof. Thus, it is possible to obtain a state display, a function display and/or also a simple illumination or lighting function. Besides, in all applications, an end cap or cover, i.e., the transparent casing part of the inventive device, can be designed in a pale milky transparent, i.e., white shade, or as a so-called smoked glass, i.e., in transparent form, but with a dark brown or black shade. In this way, it can be seamlessly introduced into the vehicle design and it also ensured that an internal printed circuit board is not visible.

The use of the n-segment principle according to the invention also can be used for displacing the flood of information from the cockpit of the motor vehicle to the individual information core centres. Thus, specifically in the dashboard area, the driver is supplied only with the most important information, and therefore can better concentrate on the traffic.

There also a concentration of the visual perceptive faculty and haptic perceptive faculty, i.e., the sense of touch, of the driver at the decisive instant on one point within the motor vehicle and the driver can consequently immediately gather the operating state of the particular devices on the vehicle. This speeding up of information gives the driver a better chance to concentrate on the essential, namely the traffic.

In addition, in a particularly advantageous manner, the push button for locking or releasing the hand brake, which occurs on all motor vehicle hand brake levers, can be equipped with the inventive device, i.e., illuminated. For example, a green illumination can be provided for the released hand brake state as a state display. Correspondingly, for the locked hand brake state, a red illumination is possible as a state display. Alternatively, a red and green illuminating display, for example, can be provided to prove a locked state of the hand brake and, in the case of a simultaneously completely satisfactory state of the hand brake system, as a combined state and function display. A red flashing display could be used for the incorrect state of the hand brake system as a function control.

With such a system, the vehicle driver, also at night, can be provided with an additional optical function and/or state control. The design also clearly is set apart from the hitherto conventional hand brake systems.

Another use possibility exists in connection with the gear shift lever. Here, the display of the gearbox function or gearbox function state, i.e., the satisfactory or unsatisfactory function, also can take place in the upper, normally somewhat thickened end piece of the generally cylindrical gear lever. In spite of this, an emblem of the vehicle brand or a function diagram of the gearbox can appear in the top portion. The vehicle brand emblem or gearbox function diagram also can be illuminated by additional, e.g., white light emitting diodes or other lighting means, also in the dark.

For example, it is possible to display the presently adopted gear by means of a light waveguide coupling via light emitting diodes staggered in several rows in the gear lever cover top. For supporting reasons, in this case, the gear adopted can be illuminated with a fixed lighting colour. To further increase the visual reminiscence, i.e., memory effect, the dome-shaped, transparent end termination of the gear lever can be illuminated with the corresponding colour below a brand emblem, so that a short side glance of the vehicle driver towards the gear lever is sufficient to check the presently adopted gear.

An illumination of the gear lever takes place separately for each gear, even if it is monochromatic and is particularly helpful for automatic vehicles. In such cases, it is necessary to check after every journey as to whether the parking gear (P) has been adopted, or whether the gear lever is at neutral (N).

Further use possibilities of the device according to the invention occur for the windscreen wiper lever, the direction indicator lever and, in general, for multifunction or dashboard levers located in the vicinity of the steering wheel.

With a cylindrically shaped direction indicator lever, which is generally positioned to the left of the steering wheel, an illumination can take place at the end and/or in the centre, so that in darkness the driver is informed as to whether or in what direction the indicator is set. It is possible to establish one colour for the present travel direction, e.g. green for right and red for left, or simply to illuminate a right-left arrow through an inside positioned printed circuit board.

Also, in the case of a windscreen wiper lever generally positioned to the right of the steering wheel, it is possible for a printed circuit board in the cylindrical end unit to display the present windscreen wiper functions, particularly interval circuit or present windscreen wiper speed. A colour combination also can give the fundamental data of the present settings to the vehicle driver.

The n-segment display also can be used with advantage for an air conditioning system control button. There, it is generally necessary to display whether hot and cold air is supplied. Generally, this takes place through a red-blue circle surrounding a setting knob for the air conditioning system and, in particular, which can be illuminated and which over the circumference, frequently 180°, changes from all-red to all-blue.

In this connection, the innovation according to the invention is that said display takes place on the actual rotary knob or button in such away that on the one hand the printed circuit board containing all the lighting elements, located in the centre of the knob or button, can be engaged together with the latter on the corresponding knob or button receptacle and a temperature display, e.g., in the form of a mixed colour combination with red and blue light emitting diodes, as a function of the button or knob position takes place in the transparent casing part of said knob or button.

Further uses exist in the field of mirror adjustment, the window regulator and sliding roof.

Nowadays, outside mirrors are normally adjusted with the aid of, in particular, a cylindrical button in the vehicle interior. This button is advantageously illuminated with the aid of the inventive n-segment display. The alternate control of white light emitting diodes makes it possible, for example, to control a directional arrow for the mirror adjustment direction in such a way that the vehicle driver, even in darkness, immediately knows in which direction one of the outside mirrors is adjusted during the operation of the mirror adjustment button.

Similarly, in the case of a window regulator button, apart from a simple illumination, it is possible to display whether the window is correctly closed, e.g., through a green illumination of the regulator button, or whether the window is still open, e.g., through a red illumination of the lever button.

Finally, in the case of a sliding roof button, advantageously there can be a function control and a function display with the aid of the inventive n-segment display. The end positions of the sliding roof control can be such that, for example, a green light emitting diode illuminates the sliding roof button and during the opening of the sliding roof, a red display is provided, i.e., for the opened, dangerous state.

Another use of the n-segment display according to the invention exists for a door locking button. Here again the state of door locking, i.e., locked or unlocked, can be displayed with the aid of different coloured lighting elements.

Application possibilities for the inventive device also exist in the external area of motor vehicles as well as for motorcycles, mopeds and scooters. Such vehicles have, for the external display of the indicator, orange or yellow-orange flashing lights, which are generally housed in a correspondingly coloured, transparent casing. As a result of the inventive n-segment display, it is possible, for example, to add a parking light, e.g., red or white. It is merely necessary to use different coloured lighting means, e.g., light emitting diodes, and unlike the situation up to now the colour of, for example, the monochromatic, transparent covering material does not have to be changed.

Other uses for the inventive device exist in connection with a joystick used for computer games, i.e., in the consumer sector, but also in avionics, i.e., for aircraft control. In the computer games sector, with the aid of the device according to the invention, the user can be particularly effectively informed via the joystick, at whose end is positioned the transparent casing part of the device, about a multitude of information. For example, a red lighting element can indicate "fire", and correspondingly, a green lighting element "no fire". Other colour combinations obviously also are possible.

Apart from the consumer sector, the safety-relevant sector is particularly important. For example, in the case of crane controls, it is easy to show whether the crane is leaving a preset pivoting range or whether a preset load is being exceeded. The obvious prerequisite is that corresponding sensors are installed for establishing the relevant data.

In the aircraft control sector, which in all recent aircraft types involves a joystick, e.g., malfunctions of a system can be displayed to the pilot by the red colouring of the semitransparent joystick end.

The invention is described in greater detail hereinafter relative to the attached diagrammatic drawings, wherein show:

FIGS. 11-14 show diagrammatic perspective views of further embodiments of the invention.

FIG. 18 shows a partial view of the device shown in FIG. 13.

Figure 15:
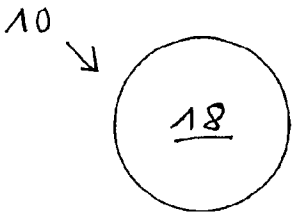
FIG. 15 shows a diagrammatic view of a prior art display device.

A prior art display device 10 is shown diagrammatically in FIG. 15. Such a full display is described in, for example, DE 195 12 915 C1 and essentially comprises a segment 18 in which can be located, for example, a plurality of LEDs as lighting or illuminating elements.

FIGS. 1 to 3 and 16 diagrammatically show examples of devices 10 according to the invention. Equivalent components are given the same reference numerals in the drawings.

According to the invention, the devices 10, in each case, have a transparent casing part or end termination 14, which is subdivided into two, three, four or n segments by one or more optical interfaces 16 forming optical separating planes 50.

Figure 4:
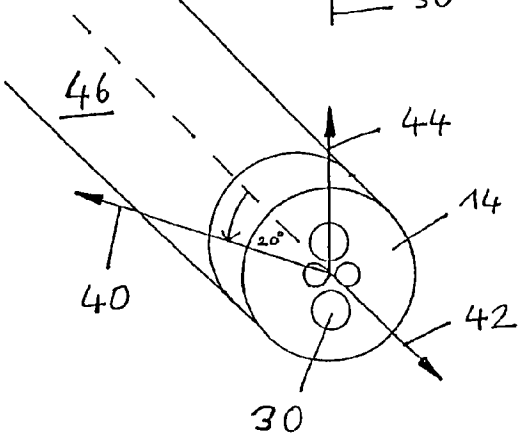
FIG. 4 shows a diagrammatic perspective part of another embodiment of the device according to the invention.
Figure 1:
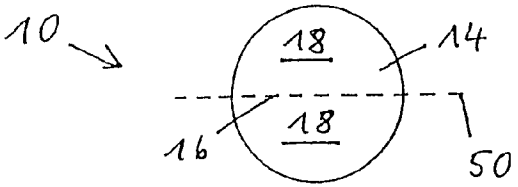
FIG. 1 shows a diagrammatic sectional view of a first embodiment of the device according to the invention.
Figure 2:
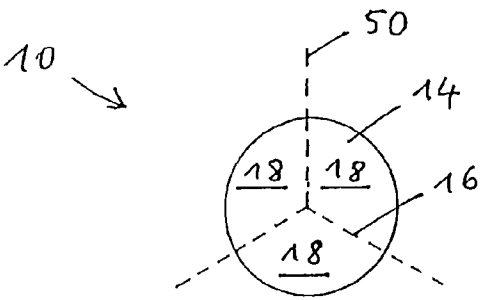
FIG. 2 shows a diagrammatic sectional view of a second embodiment of the device according to the invention.
Figure 3:
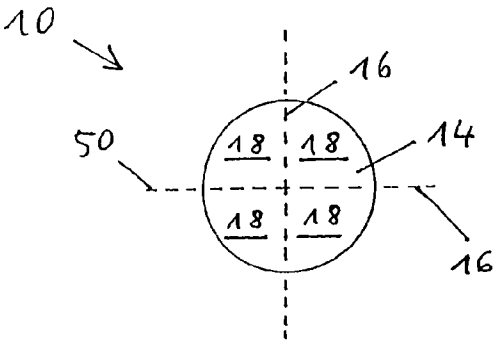
FIG. 3 shows a diagrammatic sectional view of another embodiment of the invention.

The transparent casing parts 14 shown diagrammatically in a sectional view in FIGS. 1 to 3 and 16 can in particular be construction for terminal fitting on a cylindrical, polygonal plug or cable casing 46, as is illustrated in FIG. 4 for an end termination with outgoing cable. As is also shown in FIG. 4, light from lighting or illuminating devices located in the segments 18 can be coupled out in the directions indicated by arrows 40, 42 and 44, i.e., in the entire half-space upstream of the transparent casing part 14 and in the rear space of the end termination up to the optical boundary formed by the sensor, i.e., as from the optical dead zone and by approximately 20°. In addition, the boundary of the dead zone is indicated by arrow 40. The transparent casing part 14 diagrammatically shown in FIG. 4 is also provided with cable bushings 30, to which further reference will be made in conjunction with FIGS. 5 and 6.

Figure 16:
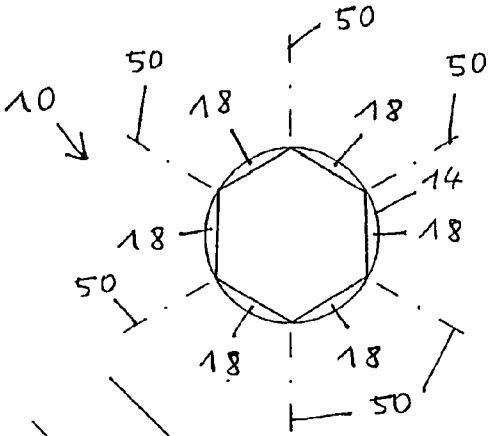
FIG. 16 shows a further cross-sectional view of the embodiment of FIG. 8.
Figure 8:
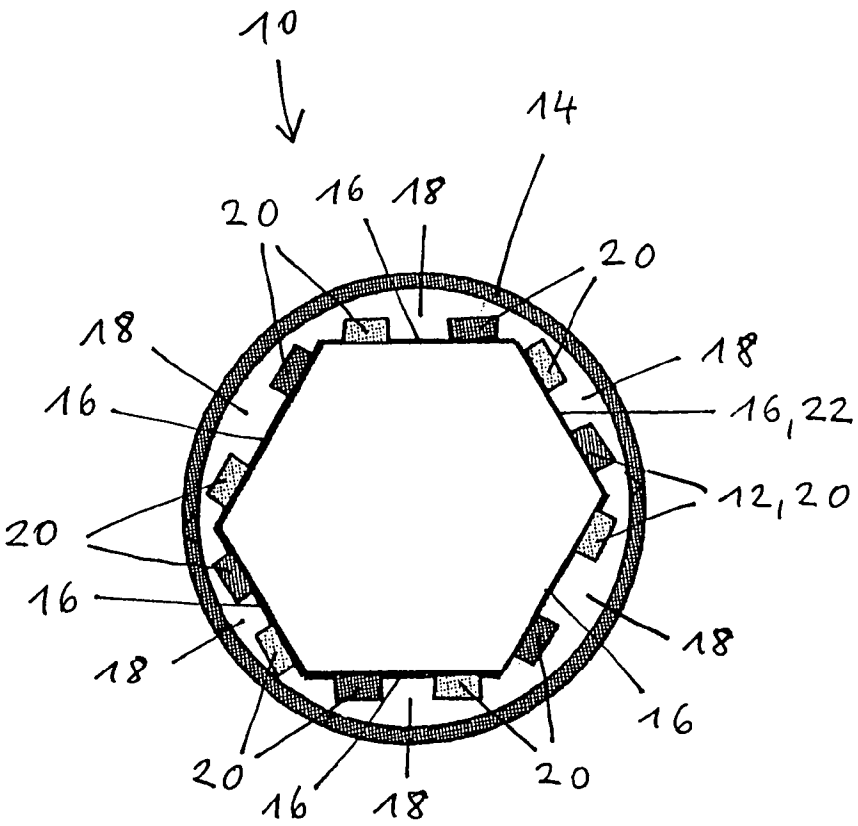
FIG. 8 shows a diagrammatic sectional view of another embodiment of the invention.

Another embodiment of a device 10 according to the invention is shown in diagrammatic sectional view in FIGS. 8 and 16 in which the transparent casing part 14 is subdivided into a total of n=6 segments 18 with the aid of optical interfaces 16, which can in particular be printed circuit boards 22, e.g., advantageously Starrflex or completely flexible boards. In each of the segments 18, at least one lighting element 20 is located as lighting devices 12 and which can in particular be light emitting diodes positioned on printed circuit boards 22.

The lighting elements 20 can have the same or different colours. For example, use is frequently made of yellow, green or red lighting elements, such as LEDs, in automation technology.

To improve the all-round visibility of the particular illuminating colour, in facing segments 18 are provided lighting elements 20 having the same colour. If lighting elements 20 with the same colour are simultaneously controlled, largely independent of the observation direction, at least one of the lighting elements 20 is visible to the user.

In the variant shown in FIG. 8, which can in particular relate to a transparent centre or end part of a cylindrical sensor unit, the lighting means or elements 20 are juxtaposed on printed circuit boards 22, e.g., on Starrflex boards.

The spatial position of the separating planes 50 in the example of FIG. 8 is diagrammatically shown in FIG. 16.

Figure 7:
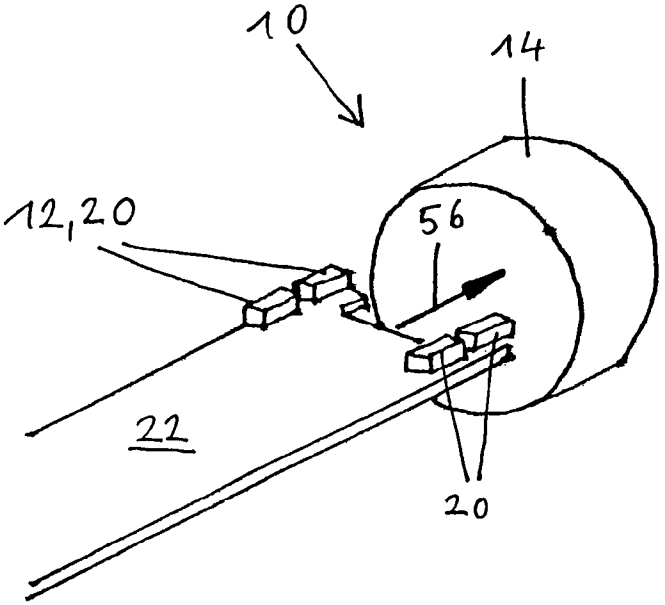
FIG. 7 shows a diagrammatic perspective view of a partial stage in the production of the device according to the invention.

FIG. 7 shows an example in which the lighting elements 20 are arranged in parallel or in succession in a row with a random number and combination of LEDs, preferably however mostly with two of these. The printed circuit board 22 with the lighting elements 20 located thereon and which can once again have different colours, is also constructed in such a way that it can be slid into the transparent casing part 14 in the direction of arrow 56 for installation purposes. For example, to the left on printed circuit board 22 can be provided a red and a green light emitting diode and to the right a red and a yellow light emitting diode. Segmentation of the transparent casing part 14 is ensured by the actual printed circuit board 22 or by a random n-angular geometrical shape constituting a segmentation.

Figure 6:
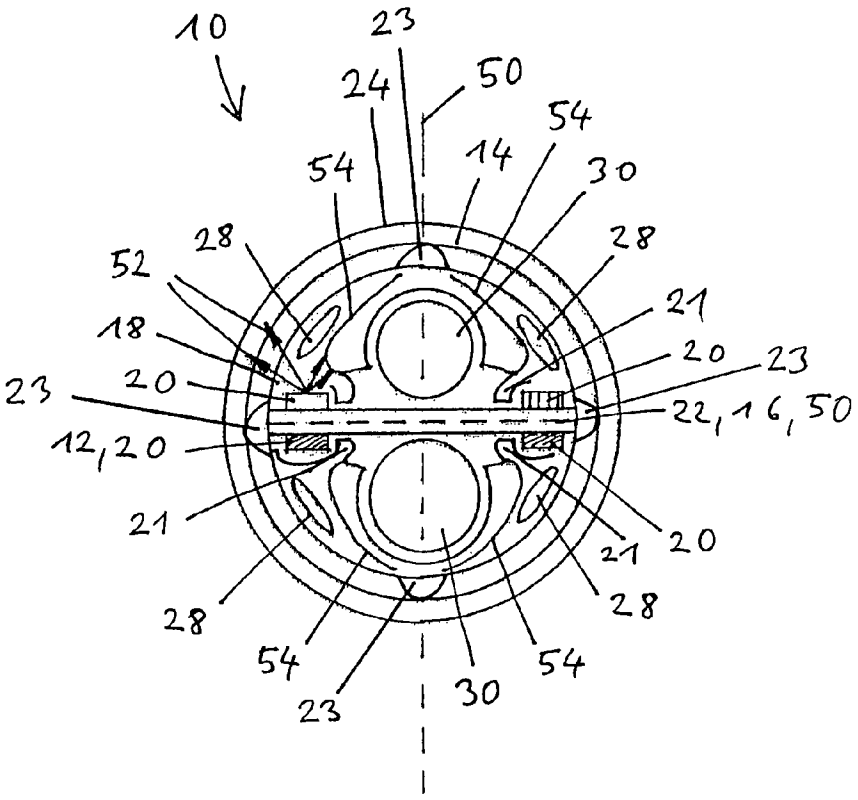
FIG. 6 shows a diagrammatic sectional view of another embodiment of the invention.
Figure 5:
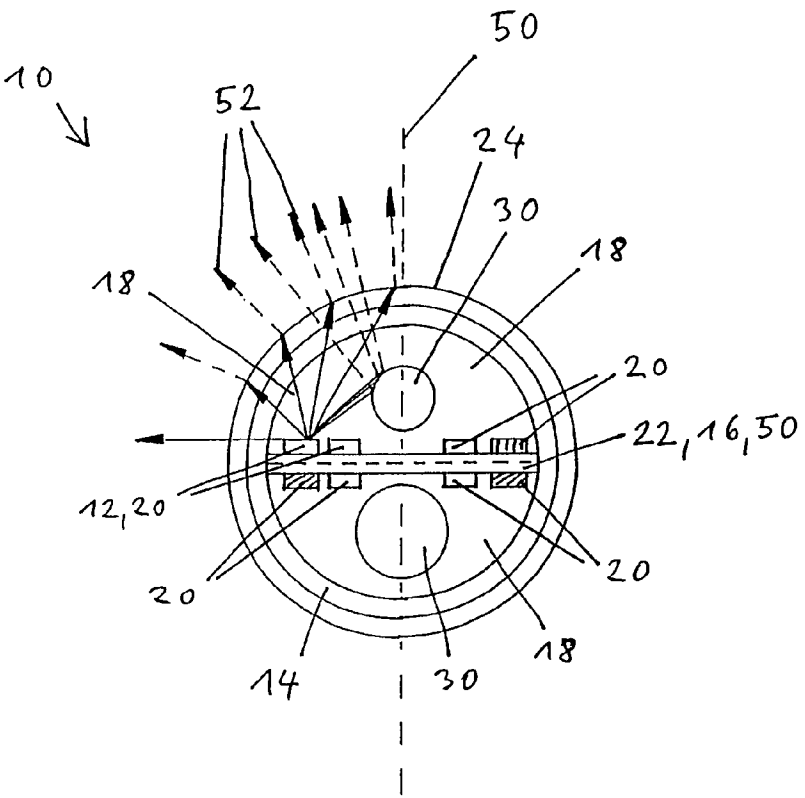
FIG. 5 shows a diagrammatic sectional view of another embodiment of the invention.

Further examples of devices according to the invention are diagrammatically shown in FIGS. 5 and 6.

In the embodiment of FIG. 7 the transparent casing part 14 also can be in the form of a part to be placed in the centre. Correspondingly, the lighting elements 20 can be positioned centrally on the printed circuit board 22, which is correspondingly constructed for sliding through the casing part 14. In addition, lighting devices 20 can be arranged not only, as in FIG. 7, on the top surface, but also on the bottom surface of printed circuit board 22 in a row and/or in parallel.

In the example of an inventive device 10 shown in FIG. 5, it is a matter of an end termination of a sensor casing for n=4 segments 18, each of which receives lighting elements 20. The optical separation of the segments 18 in the transparent casing part 14 is ensured by a printed circuit board 22 carrying the lighting elements 20, as well as by cable bushings 30. The lighting elements once again have different colours, e.g., yellow, green and red, which is illustrated by the different hatching in FIG. 5. In a further advantageous development, the lighting elements, as is also shown in FIG. 5, can be arranged in parallel. A further optical separating plane 50 is additionally provided by the cable bushings 30, provided that through an insertion bevel they introduce a further separating plane (here air) into the transparent termination.

FIG. 5 also diagrammatically illustrates the light exit possibilities through arrows 52. The light emanating from a lighting element 20 can firstly pass directly outwards through the transparent casing part 14, which is illustrated by a continuous arrow in FIG. 5. In addition, the light can be coupled out by total reflection on a medium with a very different refractive index to the exit medium. This is illustrated by the broken line arrows 52. To increase light scattering and therefore improve the visibility of an illuminating segment 18, an outside 24 of the transparent casing part 14 is segmentally roughened, and optionally, a colouring of the transparent material. As a result of these measures, an undesired viewing into the interior of the sensor is prevented. A further light scattering rise is brought about by planar-spatially distributed light scattering elements in the transparent casing part or end termination, not illustrated in the drawings. In an advantageous design, the body is made from a preferably inexpensive, easily manufacturable plastic.

A further development of the example shown in FIG. 5 is illustrated in FIG. 6. To bring about an optimum use of the light emitted by the lighting elements 20, inside faces of the transparent casing part 14 are provided with mirror coatings 54. Furthermore, in each segment 18 of the transparent casing part 14 shown in FIG. 6, is provided a clearly defined introduced cavity or gap 28 through which the emission angle of the light for one segment 18 can be limited by total reflection, provided that the segments are to appear smaller. By omitting the cavities a complete segment is fully illuminated. A light scattering and focussing also can be brought about using the light waveguide effect (LWG effect), if within the edge of the end termination, i.e., the transparent casing part 14, roughly the same optical material is used. An optimum coupling out of the emitted light into the transparent casing part or end termination takes place by means of the light coupling out arms 21, provided that a not completely transparent or even a coloured sealing compound is used. To this end, prior to the filling of the sensor with casting or sealing compound, the LEDs are bonded in with transparent adhesive. In order to improve the emission of light, optical bridges 23 are formed at four points within the wall of the transparent body 14.

Figure 9:
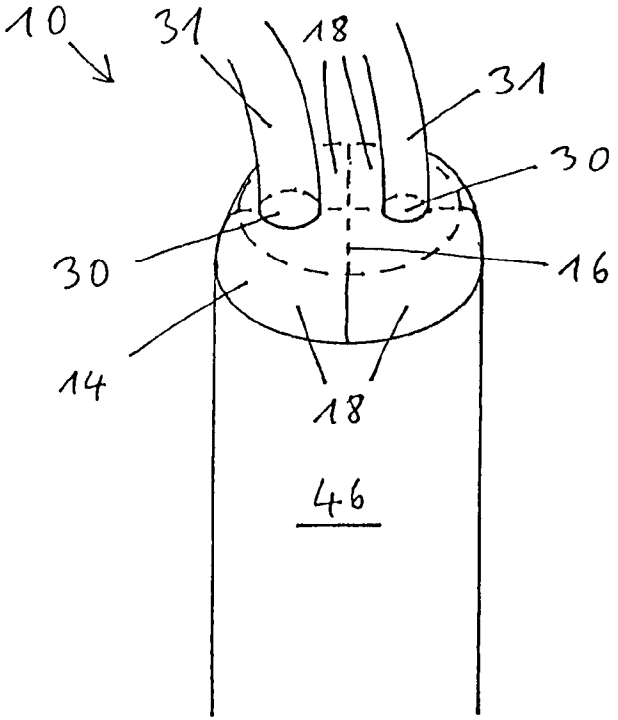
FIG. 9 shows a diagrammatic perspective partial view of another embodiment of the invention.

In a diagrammatic perspective view, FIG. 9 shows an embodiment of an inventive device 10, in which the transparent casing part 14 is provided terminally on a plug casing 46. According to the invention, the transparent casing part 14 is subdivided by optical interfaces 16, in this example into in all n=4 segments 18, which also can be referred to as quadrants here. Subdivisions with n=5 and n=6 also can be technically appropriate for certain applications. Cables 31 also contribute to the separation of the segments 18 and are passed through cable bushings 30 provided with insertion bevels and located in the transparent casing part 14 into the plug casing 46. Practical tests with the coupling out of light with the embodiment of an inventive device shown in FIG. 9 have revealed that through the transparent casing part 14 as a transparent luminaire, despite the interface, in each case, to the adjacent and facing spatial axis, part of the light is transported by the optical bridges 23 (cf. FIG. 6) if, in each case, the adjacent lighting means or elements 20 are not active. This effect is intensified by the complete sealing or casting of the segments. However, if lighting elements in adjacent segments 18 are simultaneously active, the interfaces 16 and the now negligible light quantity coupled in via the optical bridge, ensure that optical crosstalk is largely reduced.

This leads to a clear differentiation of the quadrants, e.g., for displaying switching states and for communicating with an operator. In the embodiment shown $2^4$=16 different switching states can be displayed if there is one lighting element per segment. According to a further advantageous development of the invention, the all-round visibility can be improved if, in each case, the diagonally facing quadrant has a lighting means or element 20 of the same colour at the same time. For example, if it is only required to display n=2 switching states (cf. FIG. 1), which do not have to be displayed at the same time, then with the four-quadrant display of FIG. 3, in a very advantageous development of the invention, a complete all-round visibility of the displays can be achieved. Thus, FIG. 3 can be reduced to an equivalent full display according to FIG. 15. The same applies for displays with three or n time-independently displayed switching states, i.e., only one switching state can be displayed. As this is frequently the case, this constitutes another main advantage of the invention. However, it is also possible to have a lining up of lighting elements of any colour and that can be differently controlled. In the example of FIG. 9, each quadrant or segment 18 is optically decoupled from adjacent segments 18 by optical interfaces 16.

Figure 10:
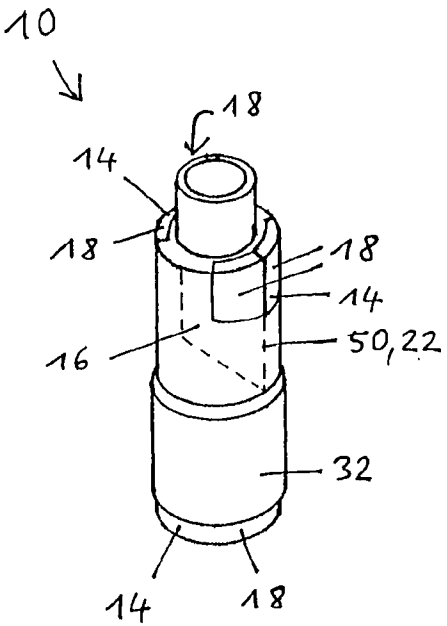
FIG. 10 shows a diagrammatic perspective view of another embodiment of the invention.

This functionality, which also can be called the multi-quadrant effect, can be obtained with any random geometry of a transparent casing part 14. For example, FIG. 10 shows a design of an inventive device 10, in which the transparent casing parts 14 are provided laterally and terminally on a plug insert 42 as part of a plug casing 46. The laterally provided, transparent casing parts 14 once again can be subdivided into several, in particular n=2 and n=4, segments 18. This fundamentally permits the same functionality, i.e., the same multi-quadrant effect, if suitable colours are used, as in the embodiment described relative to FIG. 9. Here again, a quasi-all-round visibility is obtained. Here again, a printed circuit board 22 is used for holding the lighting elements and for providing an optical interface. Each quadrant can be clearly distinguished by a user, even when the lighting elements are simultaneously activated. This gives far reaching possibilities for communications of the human-sensor interface, particularly when using memory-programmable control sensors (MPC sensors). For example, one of the segments 18 can be constructed as an infrared interface. Here again, a printed circuit board (PCB) can be used as a support for the lighting elements. To obtain the quasi-all-round visibility, the lighting elements, e.g. LEDs, in each case, can diagonally face one another for switching or fault display purposes.

Figure 17:
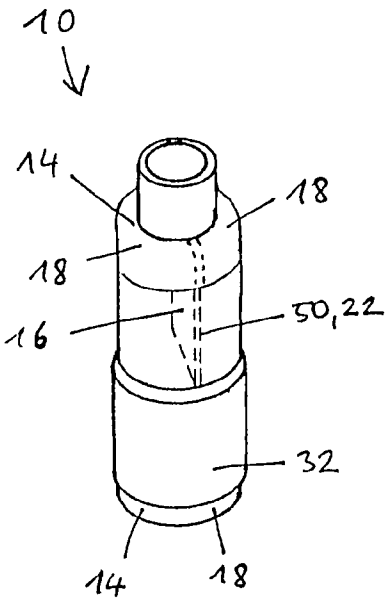
FIG. 17 shows a diagrammatic perspective view of another embodiment of the invention.

A variant of the example of FIG. 10 is shown in FIG. 17, where the transparent casing part 14, which is once again subdivided into segments 18 by a printed circuit board 22, extends around the entire casing circumference. An excellent all-round visibility is obtained with such a shape of the transparent casing part 14, which also can be looked upon, in this case, as an end termination.

Further embodiments and use possibilities of the inventive device 10 are illustrated in FIGS. 11 to 14.

Figure 12:
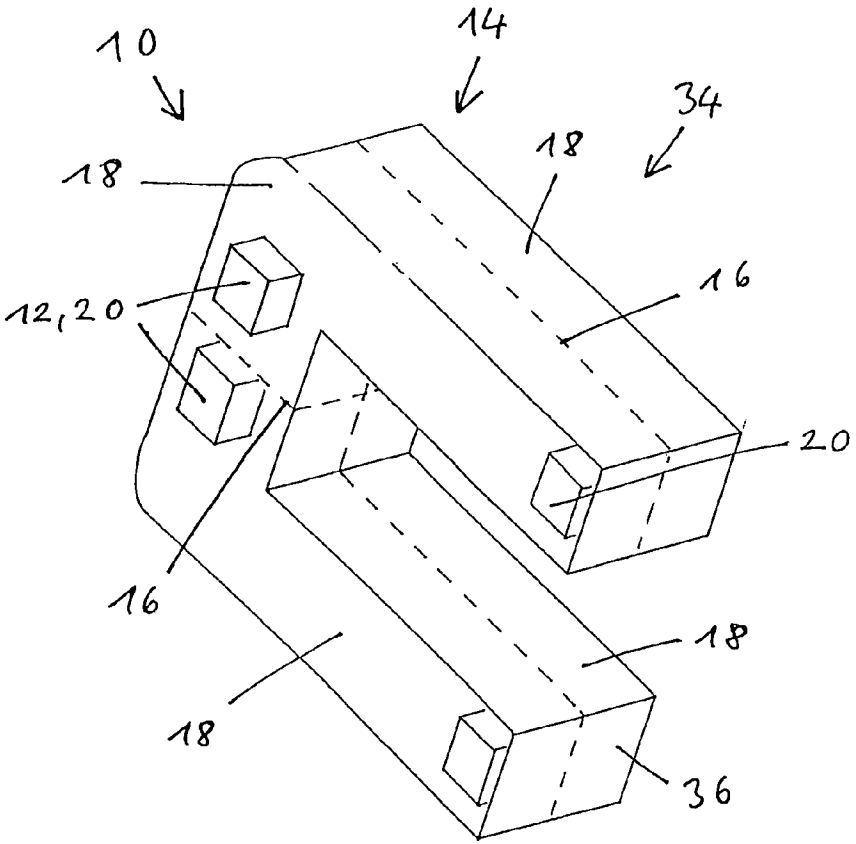
Figure 11:
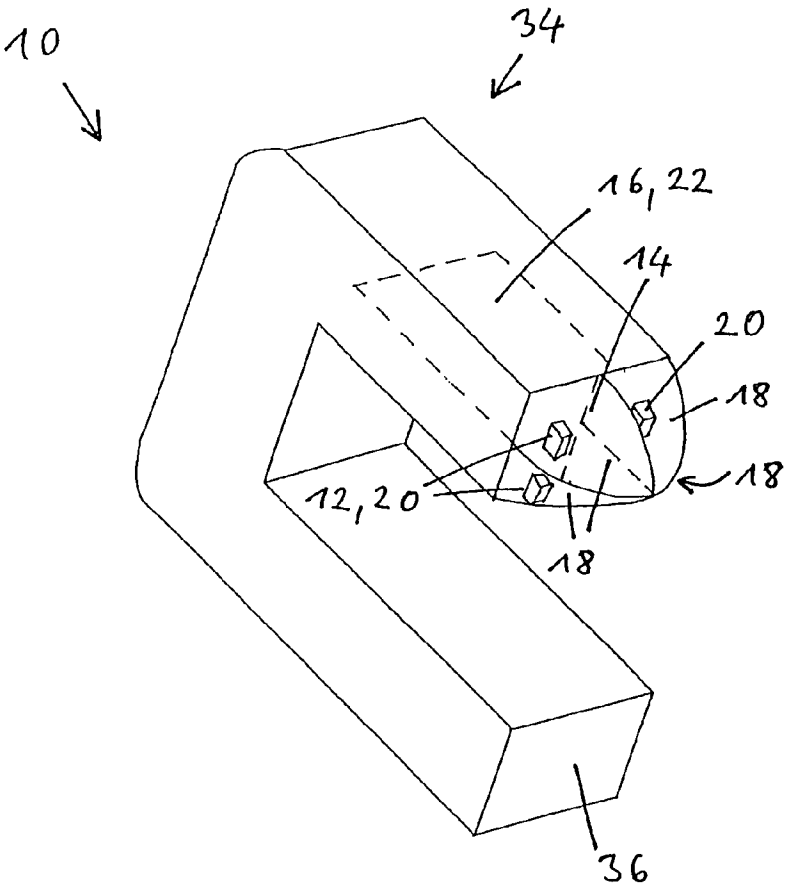

FIGS. 11 and 12 in each case show a forked sensor casing 34. In the example of FIG. 11, to the upper fork end 36 is fitted a transparent casing part or end termination 14, which is once again subdivided by optical interfaces 16 into altogether n=4 segments 18. In each of the segments 18 are provided lighting elements 20 placed on a printed circuit board 22, which serves in the above-described manner as an optical interface. The vertical separating plane is formed either by independently and additionally introduced separating planes or by non-transparent webs (e.g. insert parts) in the plastic moulding, which constitutes the transparent casing part or end termination 14. It is obviously also possible to provide a corresponding casing part 14 at the lower end 36 of the forked sensor casing 34 or at both ends thereof.

In the embodiment of FIG. 12, the entire forked sensor casing 34 is transparent. Once again the forked casing is subdivided into n=4 segments 18 by printed circuit boards serving as optical interfaces 16 and, in each of these, is provided, for example, two lighting elements 20. On activating the lighting elements in each case, the full, individual fork segments 18 light up. As in FIGS. 1 to 3, a n=4 segment display can be reduced to a n=2 or n=1 segment display by a suitable choice of the switching states at one time. Use also can be made of diagonal illumination of the segments in this case.

Thus, also in the case of forked barriers, the invention leads to an excellent quasi-all-round visibility.

FIG. 13 shows an embodiment of an inventive device 10 in which, apart from a rotary connecting piece 58, the entire, substantially cubic sensor casing 34 is transparent, i.e., is constructed as a transparent casing part 14. Once again, the separation of the individual segments 18 takes place by introduced optical, non-transparent separating planes (insert part in the plastic casing or metal partition soldered firmly to the printed circuit board, or plastics part clicked onto the printed circuit board) 16, and once again, the separating plane 16 can be constituted by a printed circuit board 22. This brings about a subdivision into n=8 cubic segments and optionally n=2 segments can be discarded for sensor retention. Here again, preferably the lighting elements 20 are constituted by light emitting diodes (LEDs, SMD-LEDs) as a result of the inexpensive installation. Optionally, the cubic sensor casing 34 need only be partly transparent. The embodiment of FIG. 13 has six spatial-planar segments 18 and three faces in each segment are illuminated. Correspondingly, all polygonal casings can be subdivided.

A single segment 18 of the embodiment of FIG. 13 is shown in FIG. 18, where it is clear to see that the segments 18 are limited to the inside sides by the separating planes 16, the latter being constituted by circuit board 23 in each case.

Finally, FIG. 14 shows an example of an inventive device 10, in which the transparent casing part 14 is constructed for central placing on a cylindrical sensor casing 34. Here, the transparent casing part 14 is subdivided into n=2 segments 18 by a printed circuit board 22 as the optical interface 16. Correspondingly, a cylindrical sensor with n=4 segments can be formed, in which the transparent casing part 14 once again extends along the cylinder axis of the sensor casing 34. Once again, each of the segments 18 contains at least one light emitting diode as lighting element 20. As a function of requirements, the central casing part need only be partly transparent. In an extreme case, the entire cylindrical sensor casing also can be made transparent, so that it can light up in its entirety and, as a function of the segmentation, in n-segments. The elongated side of the sensor casing can advantageously be polygonal, particularly quadrangular.

The invention provides a device for the optical display of switching states of a switching device or sensor, which is in particular suitable for all cylindrical sensors with one or more switching displays. By appropriate application of the concept, a quasi-all-round visibility of the display can be obtained. Using the device according to the invention, it also is easy to implement more complex applications, in which the user wishes to communicate with the sensor via LEDs. Advantageously, the device according to the invention combines the all-round visibility of the displays with the multiplicity of displays of switching states and information which it is wished to display. The inventive device is eminently suitable for sensors with plugs and with direct outgoing cable. The use possibilities of the present invention are very broad, because the device is in no way switching principle-specific.

The invention claimed is:

1. A device comprising:

a sensor comprising a plurality of switching states, wherein the sensor is a proximity switch;

a plurality of different coloured lighting devices for the optical transmission of information regarding the sensor, each lighting device having at least one lighting element;

a sensor casing including a transparent casing part for receiving the lighting elements, wherein the at least one lighting element of each lighting device is configured to emit light through facing sides of the transparent casing part; and at least one optical interface subdividing the transparent casing part into segments in which the lighting elements are received, wherein each segment is associated with at least one of the lighting elements, wherein the segments subdivide the transparent casing part in an azimuth direction around an axis of the transparent casing part, and wherein the at least one optical interface avoids optical crosstalk when a plurality of the lighting elements are simultaneously active;

wherein each of the plurality of switching states of the sensor corresponds to a unique combination of zero or more of the plurality of lighting devices having an active at least one lighting element; and wherein the transparent casing part is constructed for terminal fitting in a casing of the device and light emitted by the lighting devices is visible to a user from every azimuth direction in a polar angle range between approximately 20° and approximately 180°.

2. The device of claim 1, wherein at least one lighting device includes a plurality of lighting elements selected from the group consisting of light bulbs and LEDs.

3. The device of claim 2, wherein at least one lighting device includes a plurality of lighting elements that are placed adjacent to facing sides of the transparent casing part.

4. The device of claim 1, wherein the lighting devices are placed on a printed circuit board and are arranged in at least one of a row or in parallel to one another in order to illuminate a segment.

5. The device of claim 4, wherein the printed circuit board is slid into the transparent casing part.

6. The device of claim 1, wherein the transparent casing part is constructed for installation on a casing selected from the group of casings consisting of cylindrical, round and polygonal casings.

7. The device of claim 1, wherein the at least one optical interface is formed by at least one interface selected from the group consisting of printed circuit boards, planar shaped separations, insert parts and cables.

8. The device of claim 1, wherein an outer face of the transparent casing part is at least partly roughened to increase light scattering.

9. The device of claim 1, wherein the transparent casing part is at least partly coloured to avoid viewing inside the device.

10. The device of claim 1, wherein light scattering pigments are input in a surface-distributed manner, at least zonally, into a material of the transparent casing part to increase light scattering.

11. The device of claim 1, wherein an interior of the transparent casing part is at least partly silvered to improve leading out of the light.

12. The device of claim 1, wherein the light emission angle for a segment is limited by cavities introduced in a clearly defined manner into the transparent casing part.

13. The device of claim 1, wherein the transparent casing part includes a plurality of cable bushings with an insertion bevel as a cable insertion which is constructed as part of an optical interface.

14. The device of claim 1, wherein the transparent casing part is constructed as one of a tubular plug insert or a compact end termination.

15. The device of claim 1, wherein the sensor casing is forked.

16. The device of claim 15, wherein the transparent casing part is included on at least one fork end of the sensor casing.

17. The device of claim 1, wherein the transparent casing part forms the sensor casing.

18. The device of claim 1, wherein the at least one optical interface is formed into the device by casting resin.

19. The device of claim 1, wherein the segments are filled with at least one of a sealing or a casting compound.

20. The device of claim 1, wherein at least one of the segments includes a plurality of differently coloured lighting devices.

21. The device of claim 1, wherein at least one of the segments is constructed as an optical interface for an external computer means.

22. The device of claim 1, wherein the transparent casing part includes at least one optical bridge that, to a limited extent, overcouples the light for the clearly defined light transmission from one segment into another segment.

23. The device of claim 1, wherein the sensor casing comprises a cylindrical shape, and wherein the sensor casing includes a transparent casing part at each end of the cylindrical shape.

24. The device of claim 1, wherein each lighting device includes at least two lighting elements, and wherein the at least two lighting elements are positioned adjacent to the facing sides of the transparent casing part.

25. A device comprising:

a device casing;

a sensor comprising a plurality of switching states;

a plurality of different coloured lighting devices for the optical transmission of information regarding the sensor, each lighting device having at least one lighting element;

a sensor casing including a transparent casing part for receiving the lighting elements, wherein the at least one lighting element of each lighting device is configured to emit light through facing sides of the transparent casing part; and at least one optical interface subdividing the transparent casing part into segments in which the lighting elements are received, wherein each segment is associated with at least one of the lighting elements, wherein the segments subdivide the transparent casing part in an azimuth direction around an axis of the transparent casing part, and wherein the at least one optical interface avoids optical crosstalk when a plurality of the lighting elements are simultaneously active;

wherein each of the plurality of switching states of the sensor corresponds to a unique combination of zero or more of the plurality of lighting devices having an active at least one lighting element;

wherein the transparent casing part is constructed and positioned on the device casing so that light emitted by the lighting devices is visible by a user of the device from every azimuth direction in a polar angle range between approximately 20° and approximately 160°; and wherein the device is constructed for use in motor vehicles as part of at least one of a hand brake lever, a gear shift lever, a windscreen wiper lever, a direction indicator lever, a control button of an air conditioning system, a mirror adjustment button, a window regulator button or a sliding roof button.

26. A device comprising:

a sensor comprising a plurality of switching states, wherein the sensor is a proximity switch;

a plurality of different coloured lighting devices for the optical transmission of information regarding the sensor, each lighting device having at least one lighting element;

a sensor casing including a transparent casing part for receiving the lighting elements, wherein the at least one lighting element of each lighting device is configured to emit light through facing sides of the transparent casing part; and at least one optical interface subdividing the transparent casing part into segments in which the lighting elements are received, wherein each segment is associated with the at least one lighting element of only one of the lighting devices, wherein the segments subdivide the transparent casing part in an azimuth direction around an axis of the transparent casing part, and wherein the at least one optical interface avoids optical crosstalk when a plurality of the lighting elements are simultaneously active;

wherein each of the plurality of switching states of the sensor corresponds to a unique combination of zero or more of the plurality of lighting devices having an active at least one lighting element; and wherein the transparent casing part is constructed for terminal fitting in a casing of the device and light emitted by the lighting devices is visible to a user from every azimuth direction in a polar angle range between approximately 20° and approximately 180°.

27. The device of claim 26, wherein each lighting device comprises a single colour unique from every other lighting device in the plurality of different coloured lighting devices.

28. A device comprising:

a sensor comprising a plurality of switching states, wherein the sensor is a proximity switch;

a plurality of different coloured lighting devices for the optical transmission of information regarding the sensor, each lighting device having at least one lighting element;

a sensor casing including a transparent casing part for receiving the lighting elements, wherein the at least one lighting element of each lighting device is configured to emit light through facing sides of the transparent casing part; and at least one optical interface subdividing the transparent casing part into segments in which the lighting elements are received, wherein each segment is associated with at least one of the lighting elements, wherein the segments subdivide the transparent casing part in an azimuth direction around an axis of the transparent casing part, and wherein the at least one optical interface avoids optical crosstalk when a plurality of the lighting elements are simultaneously active;

wherein each of the plurality of switching states of the sensor corresponds to a unique combination of zero or more of the plurality of lighting devices having an active at least one lighting element; and wherein the transparent casing part is constructed for central fitting in a casing of the device and light emitted by the lighting devices is visible to a user from every azimuth direction in a polar angle range between approximately 20° and approximately 160°.

29. A device comprising:

a sensor comprising a plurality of switching states, wherein the sensor is a proximity switch;

a plurality of different coloured lighting devices for the optical transmission of information regarding the sensor, each lighting device having at least one lighting element;

a sensor casing including a transparent casing part for receiving the lighting elements, wherein the at least one lighting element of each lighting device is configured to emit light through facing sides of the transparent casing part; and at least one optical interface subdividing the transparent casing part into segments in which the lighting elements are received, wherein each segment is associated with the at least one lighting element of only one of the lighting devices, wherein the segments subdivide the transparent casing part in an azimuth direction around an axis of the transparent casing part, and wherein the at least one optical interface avoids optical crosstalk when a plurality of the lighting elements are simultaneously active;

wherein each of the plurality of switching states of the sensor corresponds to a unique combination of zero or more of the plurality of lighting devices having an active at least one lighting element; and wherein the transparent casing part is constructed for central fitting in a casing of the device and light emitted by the lighting devices is visible to the user from every azimuth direction in a polar angle range between approximately 20° and approximately 160°.

* * * * *